US009354564B2

(12) United States Patent
Imine

(10) Patent No.: US 9,354,564 B2
(45) Date of Patent: May 31, 2016

(54) IMAGE FORMING APPARATUS, IMAGE FORMING METHOD, AND PROGRAM

(71) Applicant: CANON KABUSHIKI KAISHA, Tokyo (JP)

(72) Inventor: Ryotaro Imine, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/301,224

(22) Filed: Jun. 10, 2014

(65) Prior Publication Data

US 2014/0369707 A1 Dec. 18, 2014

(30) Foreign Application Priority Data

Jun. 13, 2013 (JP) ..... 2013-124600

(51) Int. Cl.
*G03G 15/20* (2006.01)

(52) U.S. Cl.
CPC .... *G03G 15/2039* (2013.01); *G03G 2215/0129* (2013.01)

(58) Field of Classification Search
CPC ..... G03G 15/2039
See application file for complete search history.

(56) References Cited

U.S. PATENT DOCUMENTS 6,535,712 B2 * 3/2003 Richards ..... 399/341

FOREIGN PATENT DOCUMENTS

JP 2000-242107 A 9/2000

* cited by examiner

*Primary Examiner* — David Gray
*Assistant Examiner* — Sevan A Aydin
(74) *Attorney, Agent, or Firm* — Canon USA, Inc., IP Division

(57) ABSTRACT

In an image forming apparatus for controlling temperature of a fixing section based on a color material amount obtained from image data, it is determined whether the image data is a specific image, and the temperature of the fixing section is controlled so that the temperature of the fixing section becomes a predetermined temperature without using the color material amount obtained from the image data in a case where it is determined that the image data is a specific image as a determination result.

9 Claims, 10 Drawing Sheets

FIG. 4A

402

401

| | | | | | | | | | | | |
|---|---|---|---|---|---|---|---|---|---|---|---|
| 120 | 110 | 110 | 70 | 70 | 70 | 70 | 70 | 70 | 70 | 70 | 70 |
| 130 | 120 | 110 | 70 | 70 | 70 | 70 | 70 | 70 | 70 | 70 | 70 |
| 130 | 130 | 120 | 70 | 70 | 70 | 70 | 70 | 70 | 70 | 70 | 70 |
| 140 | 130 | 130 | 120 | 110 | 110 | 70 | 70 | 70 | 70 | 70 | 70 |
| 150 | 140 | 130 | 130 | 120 | 110 | 70 | 70 | 70 | 70 | 70 | 70 |
| 150 | 150 | 140 | 130 | 130 | 120 | 70 | 70 | 70 | 70 | 70 | 70 |

. . .

⋮

FIG. 4B

403

| | | | |
|---|---|---|---|
| 120 | 70 | 70 | 70 |
| 140 | 120 | 70 | 70 |

. . .

⋮

FIG. 6

600

| FIXING TEMPERATURE CONTROL INFORMATION | | | |
|---|---|---|---|
| PROCESS CONTENT | TONER APPLICATION AMOUNT | FIXING TEMPERATURE | FIXING TEMPERATURE CONTROL |
| FILLING | 200% | T1 | up |
| STAMP A | 180% | T2 | up |
| STAMP B | 170% | T2 | up |
| COPY-FORGERY-INHIBITED PATTERN A | 150% | T3 | down |
| COPY-FORGERY-INHIBITED PATTERN B | 160% | T3 | up |

IMAGE FORMING APPARATUS, IMAGE FORMING METHOD, AND PROGRAM

BACKGROUND OF THE INVENTION

1. Field of the Invention

The present invention relates to an image forming apparatus, an image forming method, and a program.

2. Description of the Related Art

There is a technique for controlling a fixing temperature of a fixing unit according to a toner application amount obtained from image data.

Japanese Patent Application Laid-Open No. 2000-242107 discloses a method for determining whether input image data is a photo image or a text image, and setting a fixing temperature of a fixing unit higher when fixing a photo image than when fixing a text image.

According to Japanese Patent Application Laid-Open No. 2000-242107, when a process which causes a change of a toner application amount is executed after the toner application amount of the image data is determined, the determined toner application amount and the toner application amount used in an actual printing become different and a highly accurate temperature control of the fixing unit cannot be performed.

SUMMARY OF THE INVENTION

The present invention is an image forming apparatus for controlling temperature of a fixing section that fixes a color material on a printing medium, the image forming apparatus including: a determination unit configured to determine whether image data is a specific image; and a control unit configured to control the temperature of the fixing section so that the temperature of the fixing section becomes a predetermined temperature in a case where the determination unit determines that the image data is a specific image and control the temperature of the fixing section by using a fixing temperature corresponding to a color material amount obtained from the image data in a case where the determination unit determines that the image data is not a specific image.

Further, the present invention is an image forming apparatus for controlling temperature of a fixing section that fixes a color material on a printing medium, the image forming apparatus including: a determination unit configured to determine whether image data is a specific image; a notification unit configured to notify a predetermined color material amount in a case where the determination unit determines that the image data is a specific image, and notify a color material amount obtained from the image data in a case where the determination unit determines that the image data is not a specific image; and a control unit configured to control the temperature of the fixing section based on the color material amount notified by the notification unit.

Further, the present invention is an image forming apparatus for controlling temperature of a fixing section based on a control material amount obtained from image data, the image forming apparatus including: a determination unit configured to determine whether the image data is a specific image; and a control unit configured to control the temperature of the fixing section targeting a predetermined temperature without using the color material amount obtained from the image data in a case where the determination unit determines that the image data is a specific image.

Further, the present invention is an image forming apparatus for controlling temperature of a fixing section based on a color material amount obtained from image data, the image forming apparatus including: an obtaining unit configured to obtain the color material amount from the image data; and a control unit configured to control the temperature of the fixing section targeting a fixing temperature corresponding to a processing content in a case where the image data from which the obtaining unit obtains the color material amount is processed.

According to the present invention, a temperature control of a fixing unit can be performed corresponding to a content that changes the toner application amount even when a process that causes a change of the toner application amount is executed after the color material amount of the image data is determined.

Further features of the present invention will become apparent from the following description of exemplary embodiments (with reference to the attached drawings).

BRIEF DESCRIPTION OF THE DRAWINGS

FIGS. 4A and 4B are explanatory views related to a toner application amount detection method of the image forming apparatus according to the present embodiment.

FIG. 6 is a diagram illustrating an example of fixing temperature control information of the image forming apparatus according to the present embodiment.

DESCRIPTION OF THE EMBODIMENTS

Embodiments of the present invention will be described with reference to the drawings.

First Embodiment

Figure 1:
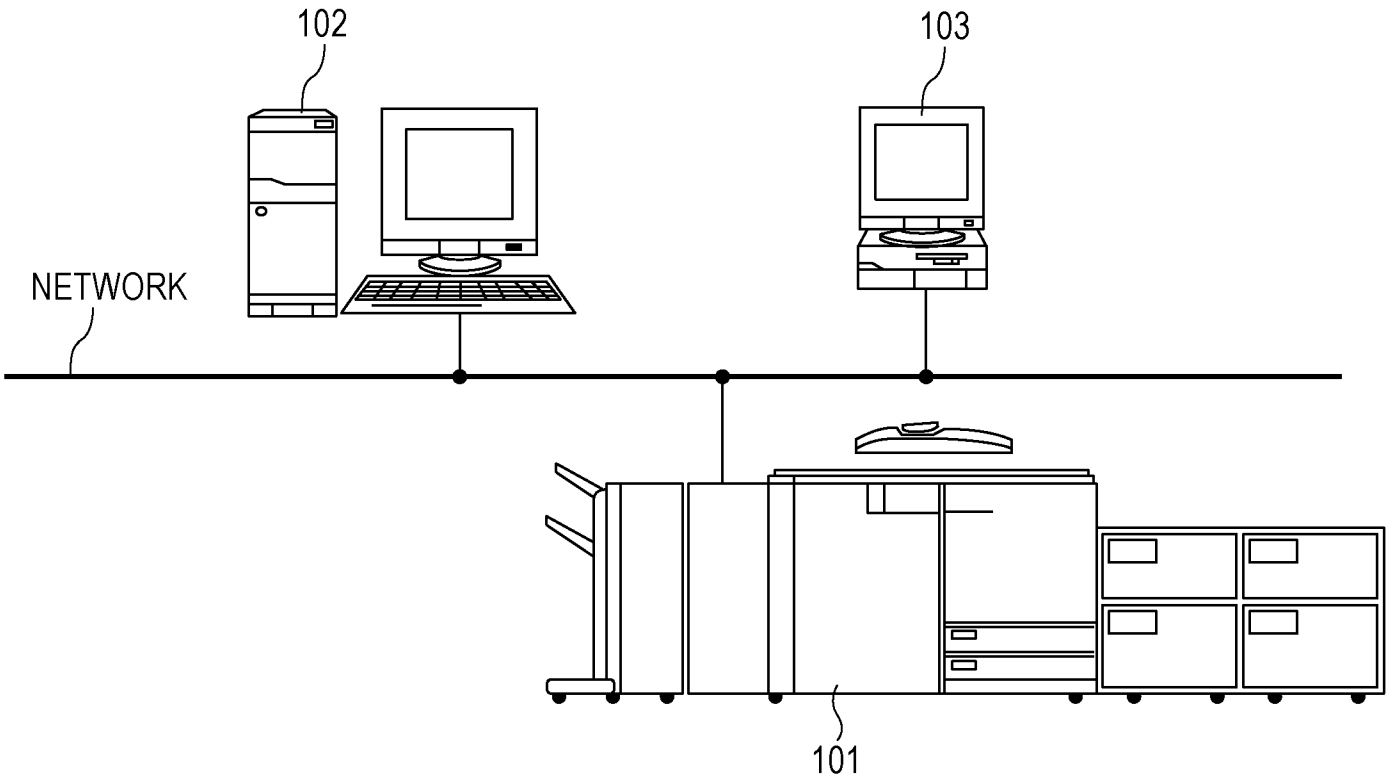
FIG. 1 is a diagram of a system configuration including an image forming apparatus according to the present embodiment.

FIG. 1 is a diagram illustrating an example of a system configuration including an image forming apparatus 101 according to an embodiment of the present invention.

The image forming apparatus 101 of the present embodiment outputs a printed material by processing various input data and executing an image formation (image creation). A print server 102 is connected to the image forming apparatus 101 via a network and a client PC 103 is connected to the image forming apparatus 101 via a network.

The image forming apparatus 101 executes printing with a function for copying and a function for printing print data received from the print server 102 and client PC 103. When printing is executed, the image forming apparatus 101 controls a fixing temperature to be a fixing temperature suitable for the print data or printing conditions.

[Explanation of Operation of Image Forming Apparatus]

Figure 2:
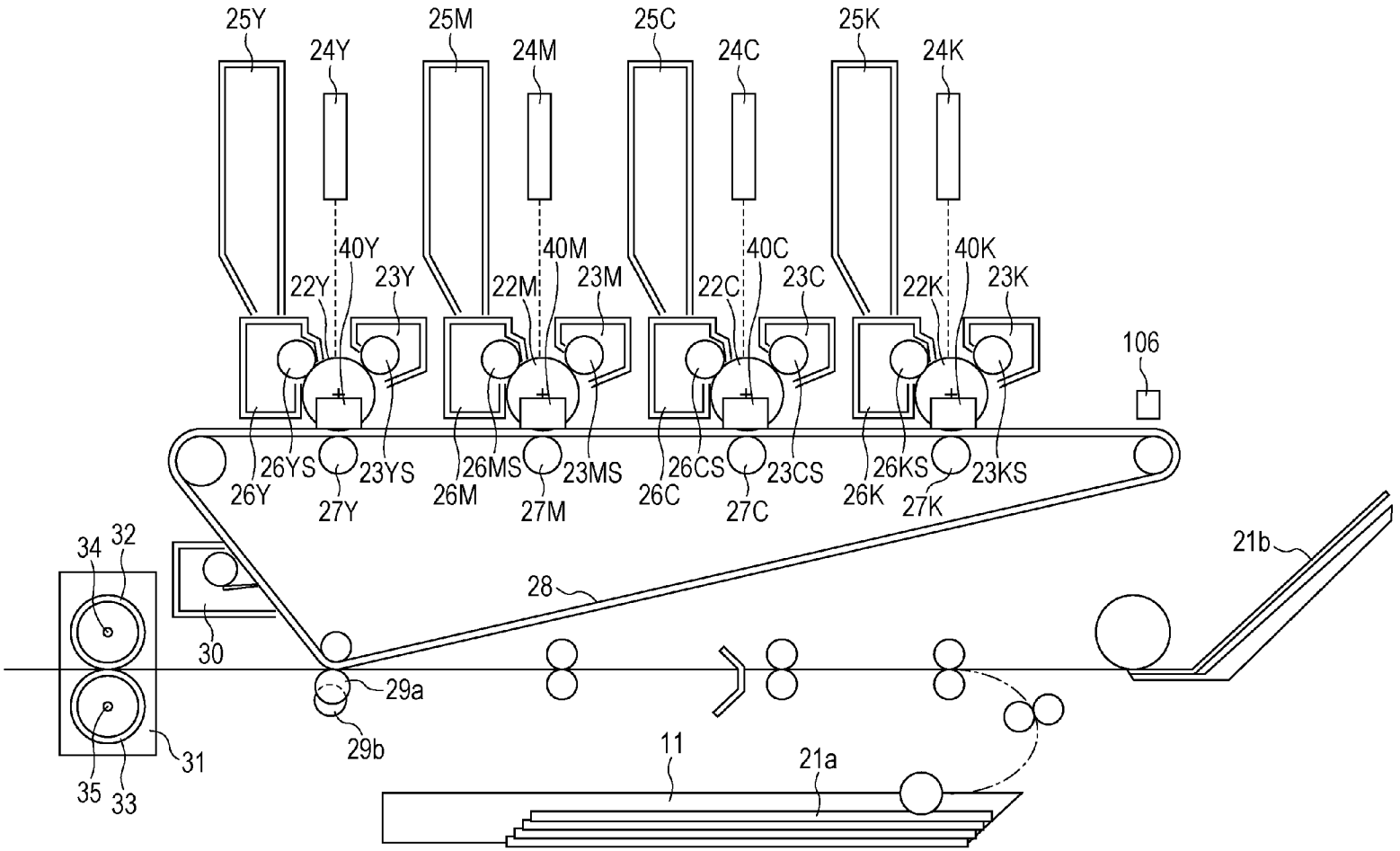
FIG. 2 is a sectional view of an electrophotographic-system image forming apparatus.

FIG. 2 is a sectional view of the image forming apparatus 101 illustrated in FIG. 1, particularly, a tandem-system color image forming apparatus having an intermediate transfer body 28 as an example of the electrophotographic-system color image forming apparatus 101. With reference to FIG. 2, operation of an image formation in the electrophotographic-system color image forming apparatus will be explained.

A charging unit includes four injection chargers 23Y, 23M, 23C and 23K for charging photosensitive members 22Y, 22M, 22C and 22K of the respective colors Y, M, C and K. Each injection charger includes a sleeve 23YS, 23MS, 23CS or 23KS.

The photosensitive members 22Y, 22M, 22C and 22K are rotated as driving force of drive motors 40Y, 40M, 40C and 40K is transferred, and the drive motors rotate the photosensitive members 22Y, 22M, 22C and 22K in a counterclockwise direction according to image forming operations.

An exposing unit is composed so that light is irradiated from scanners 24Y, 24M, 24C and 24K to the photosensitive members 22Y, 22M, 22C and 22K and an electrostatic-latent image is formed by exposing surfaces of the photosensitive members 22Y, 22M, 22C and 22K selectively.

A developing unit has a configuration including four developers 26Y, 26M, 26C and 26K for developing the colors Y, M, C and K respectively to visualize an electrostatic-latent image and each developer has a sleeve 26YS, 26MS, 26CS or 26KS. Here the developers 26 are respectively detachable.

In a transferring unit, the intermediate transfer body 28 is rotated in a clockwise direction so as to transfer a monochromatic toner image from the photosensitive member 22 to the intermediate transfer body 28. Then, the monochromatic toner image is transferred according to rotation of the photosensitive members 22Y, 22M, 22C and 22K and rotation of primary transferring rollers 27Y, 27M, 27C and 27K located facing thereto. The monochromatic toner image is efficiently transferred to the intermediate transfer body 28 by applying a proper bias voltage to the primary transferring rollers 27 and making the rotating speed of the photosensitive member 22 and the rotating speed of the intermediate transfer body 28 different. This is referred to as a primary transfer.

Further, the transferring unit overlaps a monochromatic toner image on the intermediate transfer body at each station, and the overlapped multicolor toner image is conveyed to a secondary transferring roller 29 according to the rotation of the intermediate transfer body 28. Further, the printing medium 21 is held and conveyed from a feed tray to the secondary transferring roller 29, and the multicolor toner image on the intermediate transfer body 28 is transferred on the printing medium 21 which is a sheet of paper, film, or the like. A proper bias voltage is applied to the secondary transferring roller 29 and the toner image is electrostatically transferred. This is referred to as a secondary transfer. While transferring the multicolor toner image onto the printing medium 21, the secondary transferring roller 29 contacts with the printing medium 21 at a position of 29*a*, and moves to a position of 29*b* after the printing ends.

A fixing unit includes a fixing roller 32 for heating the printing medium 21 and a pressing roller 33 for pressingly contacting the printing medium 21 with the fixing roller 32, in order to melt and fix the multicolor toner image transferred on the printing medium 21 onto the printing medium 21. The fixing roller 32 and pressing roller 33 are formed in tubular shapes and heaters 34 and 35 are provided therein. A fixing device 31 conveys the printing medium 21 having the multicolor toner image to the fixing roller 32 and the pressing roller 33, applies heat and pressure, and fixes the toner on the printing medium 21.

To the fixing unit, unillustrated temperature sensor is attached and fixing operation is controlled to be executed only when a temperature which is sufficient for fixing is detected.

The printing medium 21 after toner fixing is then discharged to an unillustrated discharge tray by an unillustrated discharge roller and the image forming operation ends.

A cleaning unit 30 is to clean toner remained on the intermediate transfer body 28. A four-color toner image formed on the intermediate transfer body 28 is transferred onto the printing medium 21 and waste toner remained after the transfer is stored in a cleaning container.

[Block Diagram of Image Forming Apparatus]

Figure 3:
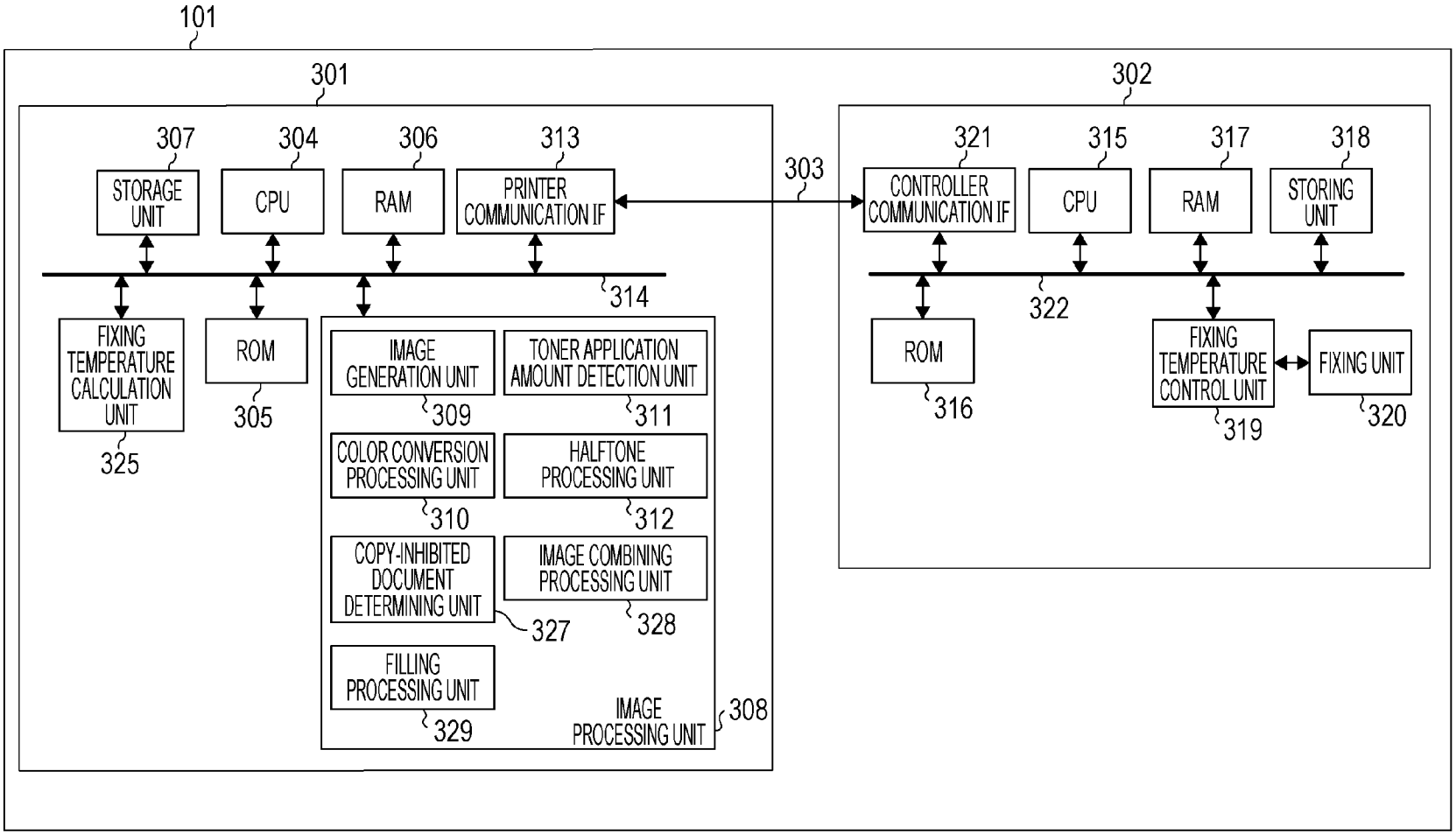
FIG. 3 is a block diagram explaining a configuration of the image forming apparatus according to the present embodiment.

FIG. 3 is a block diagram of the image forming apparatus 101 according to the present embodiment. With reference to FIG. 3, an operation related to a fixing temperature control in the image forming apparatus 101 according to the present embodiment will be explained. As illustrated in FIG. 3, the image forming apparatus 101 is mainly divided into a system controller 301 and a print controller 302. The system controller 301 has a CPU 304, a ROM 305, a RAM 306, and a storage unit 307. The print controller 302 has a CPU 315, a ROM 316, a RAM 317, and a storing unit 318. Each CPU reads a main program from the ROM and stores it in the RAM according to an initial program in the ROM. The RAM is used as a program storage and a main working memory.

An image generation unit 309 generates raster image data composed of RGB color components from print data received from the client PC 103 and outputs RGB data for each pixel. Here, a reading unit for reading a document may be provided to the image forming apparatus 101 and the image generation unit 309 may be made to handle image data read by this reading unit, instead of the image data received from the client PC 103. The reading unit here includes at least a CCD (Charged Couple Device) or a CIS (Contact Image Sensor). The image generation unit 309 reads a document using the CCD or CIS and generates RGB data.

In addition, a processing unit for performing a predetermined image process on the read image data may also be provided. Further, without providing the reading unit to the image forming apparatus 101, image data may be received from an external reading device via an unillustrated interface.

A color conversion processing unit 310 convers the RGB data generated in the image generation unit 309 into CMYK data of toner colors. The CMYK data is data indicating amounts of CMYK toners and expressed by 8-bit values from 0 to 255 for each pixel, for example. As a concrete example, when the respective colors are "0," it means that no toner is used, the density becomes higher as the values become greater, and the value "255" indicates the maximum density of each color. Regarding the above described toner amounts, "255" means "100%" and a sum of the toner amounts of the respective CMYK colors represents a toner application amount of one pixel.

A toner application amount detection unit 311 executes a detection of the toner application amount in the CMYK data generated in the color conversion processing unit 310. A concrete method of the toner application amount detection will be described later with reference to FIGS. 4A and 4B. The CMYK data to which the toner application amount detection is completed is transmitted to a halftone processing unit 312. Further, when the toner application amount detection for a whole page is completed, toner application amount information is notified to a fixing temperature calculation unit 325.

The fixing temperature calculation unit 325 calculates a minimum temperature required to fix, in a fixing unit 320, the toner application amount detected in the toner application amount detection unit 311. Here, a method for calculating the minimum temperature of fixing unit 320 required to fix a toner application amount will be described later with reference to FIG. 5.

It has been explained that the application amount information detected in the toner application amount detection unit 311 is notified to the fixing temperature calculation unit 325 so that temperature information is calculated. In addition to the above, the application amount information detected in the toner application amount detection unit 311 may be notified directly to the print controller 302 via a printer communication IF 313 and a communication line 303 and the fixing temperature calculation can be executed in the print controller 302. In either cases, the format of information to be notified may not be limited as long as the fixing temperature is decided based on notified information for controlling the fixing temperature. The content of the notified information may not be limited to later described fixing temperature control information illustrated in FIG. 6.

The halftone processing unit 312 executes a halftone process on each color data output from the toner application amount detection unit 311. As a concrete configuration of the halftone processing unit 312, a screening process or an error diffusion process is employed. The screening process is to convert input image data into an N-value based on the input image data and predetermined dithering matrix. Further, the error diffusion process performs a process to convert a target pixel of input image data into an N-value by comparing the target pixel with a predetermined threshold value, and to diffuse a difference between the target pixel and the threshold value generated by the N-value conversion process to peripheral pixels to be sequentially processed in the N-value conversion.

A copy-inhibited document determining unit 327 determines whether or not a document set on a document positioning plate is a copy (duplication)-inhibited document or a specific image including a specific pattern. An image combining processing unit 328 performs a process to combine a copy-forgery-inhibited pattern or a stamp image to the halftone image output from the halftone processing unit 312. A filling processing unit 329 performs a filling process on the halftone image output from the halftone processing unit 312. The filling processing unit 329 performs a filling process on an image area of the document which is determined as a copy-inhibited document (duplication inhibited document) or a specific image in the copy-inhibited document determining unit 327. The filling process is a process to convert at least an area in the document which is determined as a copy-inhibited document into an area having a density equal to or greater than a predetermined value.

A printer communication IF 313 and a controller communication IF 321 are interfaces (IF) used to execute communication between the system controller 301 and the print controller 302. The information transmitted here includes information related to the control of the temperature of the fixing unit 320 such as control signals from the system controller 301, a toner application amount detected by the toner application amount detection unit 311, a copy-inhibited document detection result, and an image combining set information, and the like, in addition to the data to be printed.

A fixing temperature control unit 319 performs the temperature control of the fixing unit 320 based on the target temperature calculated in the fixing temperature calculation unit 325, the toner application amount information detected in the toner application amount detection unit 311, or later described fixing temperature control information 600 of FIG. 6.

[Toner Application Amount Detection Method]

Next, a method for detecting a toner application amount in the toner application amount detection unit 311 will be explained with reference to FIGS. 4A and 4B.

Here, the toner application amount indicates a toner amount per unit area and is expressed in percentage. Concretely, when a maximum value of each CMYK colors is 100% and two colors of the maximum value are overlapped, the toner application amount of the pixel is defined to be 200%. Since each color has a tone level, each color may be expressed a value from 0 to 100%. For example, the toner amount increases in a case of an image in which four of CMYK colors are fully used in a full-color printing mode, and the toner amount becomes small in a case of a black-and-white image of a single K color.

Firstly, when CMYK data is received, the toner application amount detection unit 311 calculates a toner application amount required in each pixel. FIG. 4A illustrates a part of one-page image data, 401 represents a minimum unit of one pixel and 402 represents a pixel block of a 3×3 pixel unit. Further, the values shown in each pixel frame in FIG. 4A represent toner application amounts of pixels detected by the toner application amount detection unit 311. Here, an example is described that an average value of toner application amounts within a pixel block is calculated using a unit of a 3×3 pixel block in the toner application amount detection unit 311. Here, the reason why an average value within the pixel block is calculated is because the temperature required to fix an image generally depends on the toner amount of a certain region, not the toner application amount of a single pixel unit. Further, the example of the figure illustrates a block size of 3×3 pixels as an example; however, it is not limited by this example and any block size can be used. Further, an average value within a pixel block is calculated here; however, a minimum value or a maximum value within the pixel block may be used. Here, a pixel 403 of FIG. 4B corresponds to the 3×3 pixel block 402 of FIG. 4A. The values shown in each pixel in FIG. 4B represent the average value of the toner application amounts in the 3×3 pixel block of FIG. 4A.

Sequentially, after a process for calculating an average value of the toner application amounts of pixel blocks in one page is completed, the toner application amount detection unit 311 notifies a maximum amount in the average values of the all blocks in the page to the fixing temperature calculation unit 325. The maximum value to be notified is a representative value of the target page which is used to control the temperature for fixing a toner image of the target page in the fixing unit 320. The method to obtain the representative value of the toner application amounts for the image data of one page has been described.

[Fixing Temperature Calculation Method Based on Toner Application Amount]

Next, a method for calculating a fixing temperature required for fixing a target page based on the toner application amount information detected in the toner application amount detection unit 311 will be explained with reference to FIG. 5.

As described above, the toner application amount indicates a toner amount per unit area of an image. In order to fix toner without any fixing failure, the temperature of the fixing unit 320 needs to be set at a fixing temperature which enables to surely fix the maximum value of the toner application amounts in the target page.

Since the maximum toner application amount differs in each image data to be printed, the temperature required for fixing differs in each image data and a higher temperature is required as the toner application amount becomes greater.

Figure 5:
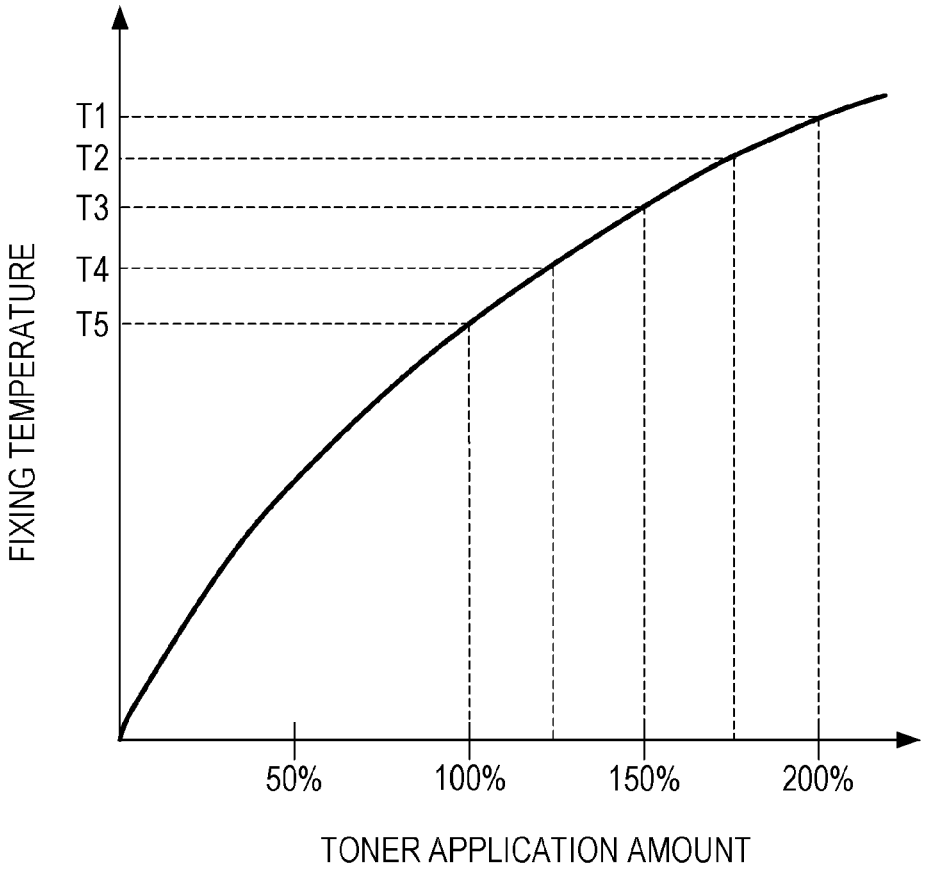
FIG. 5 is a diagram illustrating a relationship between the toner application amounts and fixing temperatures according to the present embodiment.

FIG. 5 is a figure illustrating an example of a relationship between the toner application amounts and fixing temperatures in the image forming apparatus 101 according to the present embodiment. The horizontal axis represents toner application amounts and the vertical axis represents temperatures required for fixing. With reference to FIG. 5, for example, when the detection result by the toner application amount detection unit 311 is 200%, the minimum temperature required for fixing is T1, and when the detection result of the toner application amount is 100%, the minimum temperature required for fixing is T5.

When the temperature of the fixing unit 320 is made to be a temperature which can fix the maximum toner application amount existing in the print page, any problem such as a fixing failure may not occur in the entire image. Thus, with reference to FIG. 5, the minimum temperature required to fix the target page is obtained based on the toner application amount detected by the toner application amount detection unit 311.

Since the relationship illustrated in the graph of FIG. 5 is used in the temperature control of the fixing unit 320, it is stored as a format of a look-up table in a storage unit 307 or the RAM 306, for example.

[Fixing Temperature Control Based on Toner Application Amount Detection Result]

A flowchart of a fixing temperature control process using a toner application amount detection result in the image forming apparatus 101 according to the present embodiment will be explained with reference to FIGS. 7A and 7B. The process flows of FIGS. 7A and 7B will be explained using the block configuration of the image forming apparatus 101 of the present embodiment explained in FIG. 3.

Figure 7A:
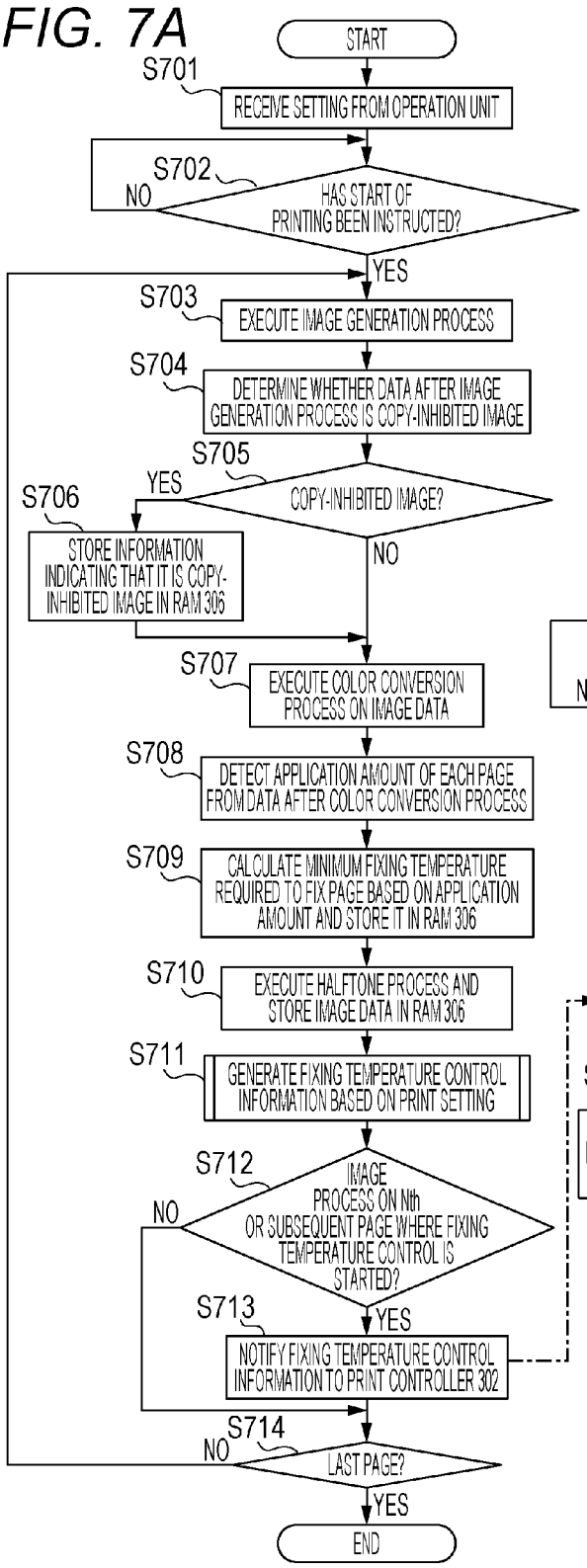
FIGS. 7A and 7B are flowcharts illustrating a flow of a process according to the present embodiment.
Figure 7B:
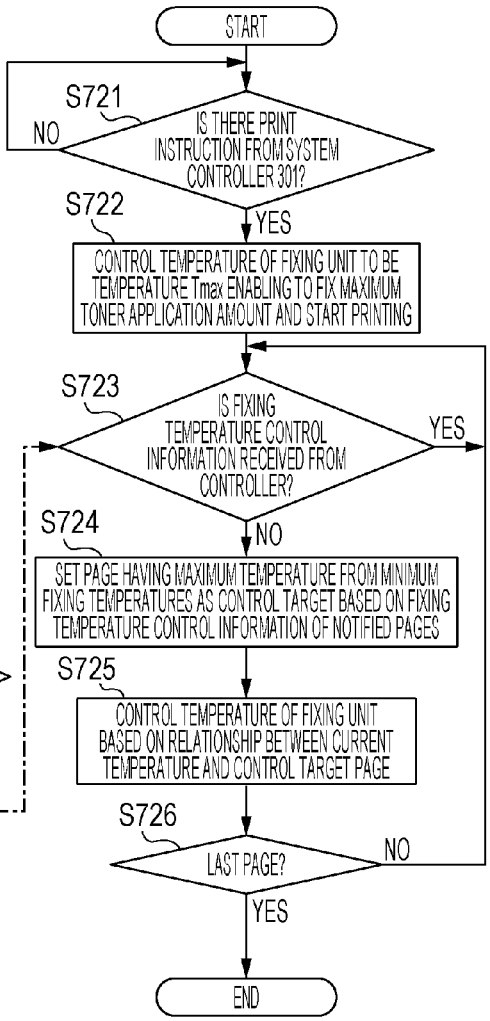

FIG. 7A illustrates a process executed under the control of the CPU 304 of the system controller, and FIG. 7B illustrates a process executed under the control of the CPU 315 of the print controller. Firstly, the process executed based on the control by the CPU 304 of the system controller will be explained with reference to FIG. 7A.

In step S701, setting for combining a copy-forgery-inhibited pattern or a stamp is received from an operation unit of the image forming apparatus 101 or an operation unit of the client PC 103. In a case that a copy-forgery-inhibited pattern or a stamp is not combined, the process in step S701 is skipped.

In step S702, it is determined whether a start of printing is instructed. When a start of printing is instructed, a print job input from an image reading unit of the image forming apparatus 101 and an external device such as the client PC 103 is received and a print process starts.

In step S703, the image generation unit 309 generates raster image data, which is printable, from the print data received from the client PC 103. RGB data which is the generated raster image data is output for each pixel. In step 703, a document may be read using the reading unit of the image forming apparatus 101 and RGB data may be generated from the read data.

In step S704, the copy-inhibited document determining unit 327 determines whether the image data generated in S703 is image data of the copy-inhibited document or not. In a case where the image data is determined to be image data of a copy-inhibited document in S705, the process proceeds to step S706 and, in a case where the image data is determined that it is not image data of a copy-inhibited document, the process proceeds to step S707. In step S706, information indicating image data of a copy-inhibited document is stored in the RAM 306. In step S707, the color conversion processing unit 310 converts the RGB data into CMYK data.

Next, in step S708, the toner application amount detection unit 311 detects a toner application amount of the CMYK data of the target page generated in step S707. Here, the toner application amount detection method is the method described above with reference to FIGS. 4A and 4B. In the process flow of the image forming apparatus 101 according to the present embodiment, a toner application amount detection is executed on the data before the halftone process in step S710 in order to improve accuracy of the toner application amount detection.

In step S709, the fixing temperature calculation unit 325 calculates a minimum temperature required to fix the target page based on the toner application amount information detected in S708. Here, the method for calculating the minimum temperature required to fix the target page based on the toner application amount information is the method described above with reference to FIG. 5.

In step S710, the halftone processing unit 312 performs a screening process or an error diffusion process on the CMYK data generated in step S707 and converts the CMYK data into N-values. The image data after the halftone process is stored in the RAM 306.

In step S711, the CPU 304 generates fixing temperature control information based on the minimum fixing temperature information calculated in step S709 and print setting set in step S701. The fixing temperature control information will be explained later with reference to FIG. 8.

Next, in step S712, the CPU 304 determines whether the process target page is Nth or subsequent page where the temperature control is started and, in this example, it is determined whether it is the fifth or subsequent page. In step S712, when the process target page is the fifth or subsequent page where the temperature control is started, the process proceeds to step S713. In step S712, when the process target page is a page prior to the Nth page, the process proceeds to step S714.

In step S713, the CPU 304 notifies the fixing temperature control information generated in S711 to the CPU 315 of the print controller 302 via the printer communication IF 313. Here, in step S713, a color material amount calculated in step S708 may be notified. In step S714, the CPU 304 determines whether there is a subsequent page and, in a case that a subsequent page exists, the processes from step S703 are repeated. When a following page does not exist, the process ends.

Next, the process executed based on the control of the CPU 315 of the print controller 302 will be explained with reference to FIG. 7B.

In step S721, the CPU 315 waits for a print instruction from the system controller 301. When there is a print instruction from the system controller 301, the process proceeds to step S722.

In step S722, in order to print first four pages without lowering the productivity, the fixing temperature control unit 319 controls the temperature of the fixing unit 320 to be a temperature Tmax which enables to fix the maximum toner amount and starts printing.

In order to control the temperature of the fixing unit prior to fixing of a print image, it is required to notify the toner application amount information several pages in advance. Thus, image data to be printed and the toner application amount information detected in the image data are accumulated for an amount of necessary pages to notify in advance. This configuration allows to control the fixing temperature without lowering the productivity because the control of the fixing temperature can be started in advance. In purpose of simplify the explanation, the image forming apparatus 101 which notifies the toner application amount of the page which is the fourth page from the currently fixed page will be explained. Further, immediately after printing is started, when the temperature of the fixing unit is controlled after detecting the toner application amount, the productivity is lowered since an immediate action cannot be taken in response to the print instruction from the user. Thus, the fixing temperature control is not executed until the first four pages after printing is started, the temperature control is performed by controlling the temperature to be a fixing temperature which enables to fix the maximum toner application amount assumed in the image forming apparatus 101 and by detecting the toner application amount from the image data of the fifth and subsequent pages after printing.

In step S723, a reception of a minimum temperature required to fix the target page from the system controller 301 is waited. When a fixing temperature is received from the system controller 301 in S723, the process proceeds to step S724. The fixing temperature control information received here is information required to fix the fourth page from the currently fixed page.

In step S724, the fixing temperature control unit 319 sets a page having the maximum temperature as a control target page from plural pieces of fixing temperature control information which are already notified regarding the four pages to be printed. In step S725, the temperature of the fixing unit 320 is controlled regarding the current fixing temperature and the fixing temperature of the control target page determined in S724. Concretely, when the fixing temperature of the control target page is higher than the current fixing temperature, the temperature of the fixing unit 320 is raised. When the fixing temperature of the control target page is lower than the current fixing temperature, the temperature of the fixing unit 320 is controlled to be lowered. In step S726, the CPU 315 determines whether it is the last page or not and when it is not the last page, the processes from step S723 are repeated, and when it is the last page, the process ends.

Here, the process to detect the application amount in step S708 and the halftone process in step S710 may be executed in reverse order. In other words, after executing the halftone process on the data to which the image generation process is executed in S703, the process to detect the application amount may be executed on the data to which the image generation process is executed in S703.

Figure 8:
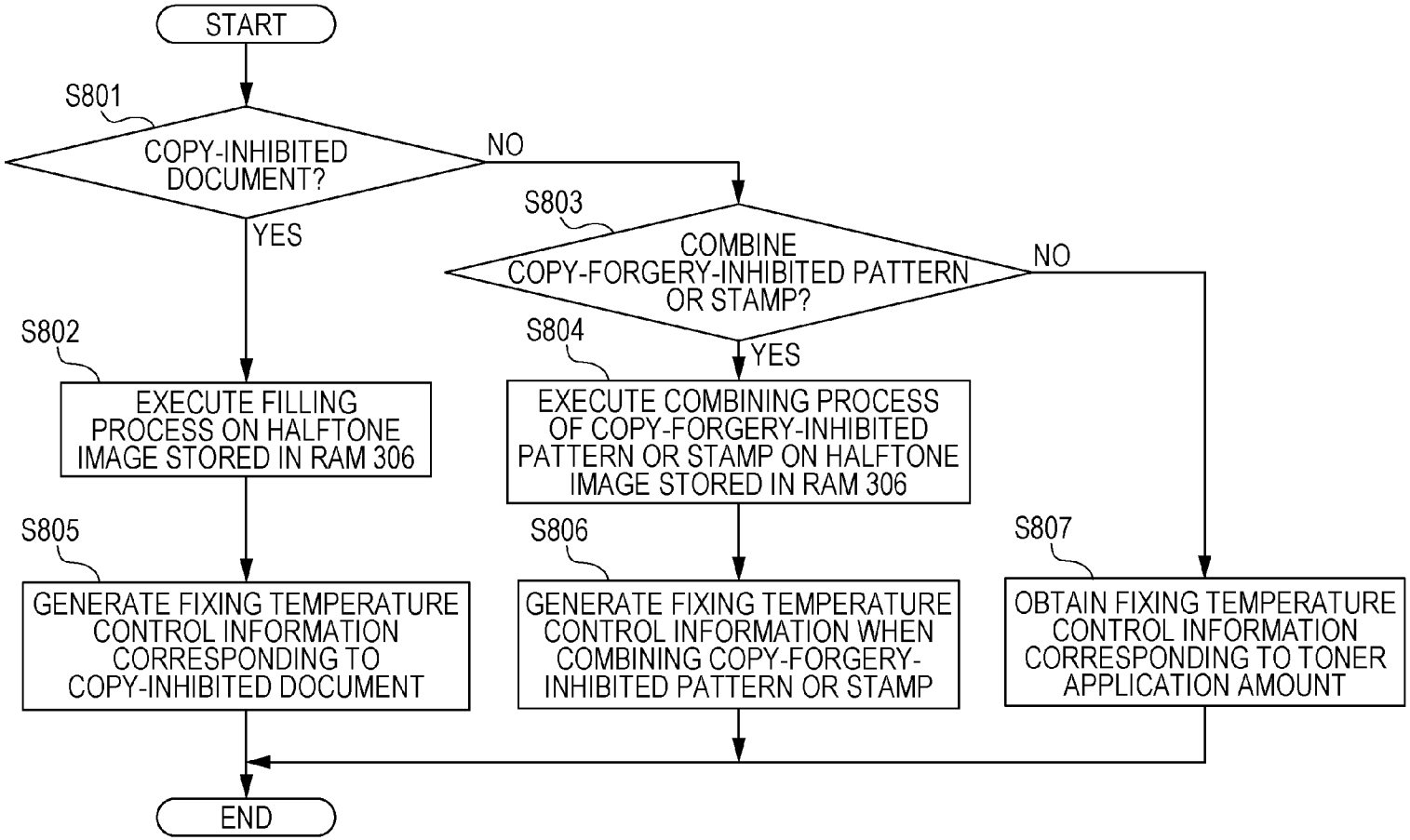
FIG. 8 is a flowchart illustrating an example of a fixing temperature control information generation process according to the present embodiment.

FIG. 8 is a flowchart illustrating details of the process flow of step S711 in FIG. 7A.

In step S801, it is determined whether the image data is data of a copy-inhibited document (duplication-inhibited image) by referring to the information, stored in the RAM 306, which indicates whether it is the copy-inhibited document or not. Here, in step S801, it may be determined whether the image data includes a specific mark or a specific pattern (specific image) or not, in addition to whether it is a duplication-inhibited image.

Figure 10A:
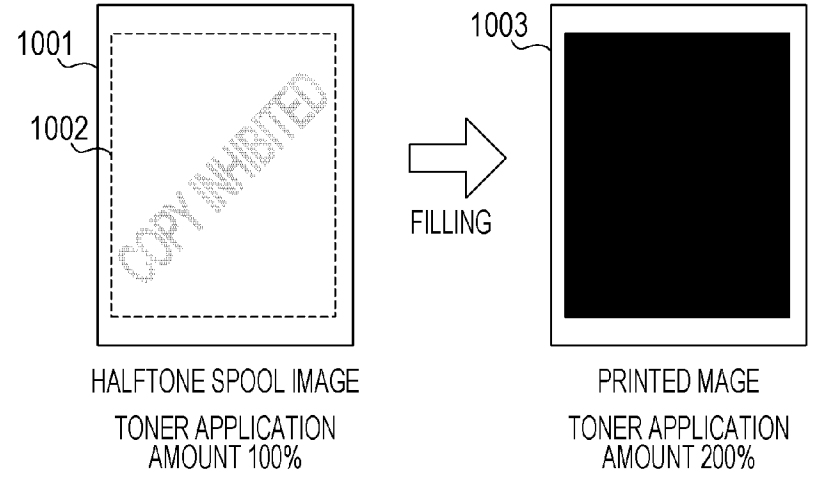
FIGS. 10A and 10B are diagrams explaining a relationship of the toner application amount with a filling process and a copy-forgery-inhibited pattern or stamp combing process in the image forming apparatus according to the present embodiment.

In a case where it is determined to be a specific image (copy-inhibited document) in step S801, the process proceeds to step S802, and in a case where it is determined not to be a copy-inhibited document in step S801, the process proceeds to step S803. In step S802, a filling process is executed on the image after the halftone process which is stored in the RAM 306 in step S710. In step S802, as illustrated in FIG. 10A, the filling processing unit 329 executes processing to fill the input image with a density equal to or greater than a predetermined density. Then, in step S805, fixing temperature control information corresponding to the copy-inhibited document is generated by referring to a later described correspondence table of the fixing temperature control information illustrated in FIG. 6. The fixing temperature corresponding to the copy-inhibited document is a predetermined temperature required to fix in a stable manner the toner application amount which is increased for the filling process. Since the toner application amount is increased for the filling process, the fixing temperature is required to be set higher compared to the case that it is determined the image data is not a copy-inhibited document.

In step S803, it is determined whether copy-forgery-inhibited pattern or stamp combining is set in the image data or not. The copy-forgery-inhibited pattern combining or stamp printing can be set in an unillustrated operation unit having a UI (user interface) of the image forming apparatus 101 or client PC 103. In a case where it is determined in step S803 that copy-forgery-inhibited pattern or stamp combining is set in step S701, the process proceeds to step S804, and in a case where it is determined that copy-forgery-inhibited pattern or stamp combining is not set, the process proceeds to step S807. In step S804, a copy-forgery-inhibited pattern or stamp combining process is executed on an image after the halftone process which is stored in the RAM 306. Then, in step S806, fixing temperature control information is generated for a case that a copy-forgery-inhibited pattern or a stamp is combined, with reference to the later described correspondence table of the fixing temperature control information illustrated in FIG. 6. As illustrated in FIG. 6, the fixing temperature is determined according to the content of image processing such as the filling process, copy-forgery-inhibited pattern combining or stamp combining.

The fixing temperature control information may include a factor of an occurrence of an increased toner application amount in spite of a fixing temperature. For example, as fixing temperature control information, being a "copy-inhibited document" or a print mode such as combining of "copy-forgery-inhibited pattern" or "stamp" may be notified. Other pieces of fixing temperature control information will be explained with reference to FIG. 6.

FIG. 6 is an example of the fixing temperature control information 600 notified from the system controller 301 to the print controller 302 in a fixing temperature control method by the image forming apparatus 101 according to the present embodiment. In the present embodiment, it is mainly explained that the toner application amount obtained from the image data in S708 or the fixing temperature obtained based on the toner application amount in S709 is notified. The fixing temperature control information 600 in the image forming apparatus 101 according to the present embodiment is not limited to the toner application amount or fixing temperature and may be the toner application amount required to the content or processing in the process performed on the image data after the halftone process. As the processing content, there is a filling process, stamp combining, or copy-forgery-inhibited pattern combining for example. Further, the toner application amount required in the performed processing content may be used. In addition to the above, the fixing temperature control information of "up" or "down" may be generated and notified to control based on an alternative choice whether to raise or lower the fixing temperature.

Further, as illustrated in FIG. 6, the fixing temperature control information may be stored in the RAM 317 of the print controller 302 as a correspondence table of the processing contents, toner application amount and fixing temperature. When the toner application amount is notified from the system controller 301, the temperature of the fixing unit is controlled with reference to the table illustrated in FIG. 6 which is stored in the RAM 317.

In step S807, the fixing temperature calculated in step S709 is obtained from the RAM 306 as fixing temperature control information. The obtained fixing temperature is notified to the print controller 302 in step S713.

Here, in the present embodiment, the processes in S708 and S709 are executed even in a case where the document is determined to be a copy-inhibited image in step S705; however, the processes in S708 and S709 may be skipped in a case where the document is determined to be a copy-inhibited image in step S705. In other words, in a case where the document is determined to be a copy-inhibited image in S705, the fixing temperature of the fixing unit is set to be a predetermined temperature without executing the processes in S708 and S709. Here, the predetermined temperature is a temperature required to fix in a stable manner the toner application amount increased for the filling process of the copy-inhibited image.

Further, in a case where it is determined that the document is not a copy-inhibited image in step S705, a toner application amount is detected in the target page in S708 and the fixing temperature control according to the toner application amount is executed in S709.

Figure 10B:
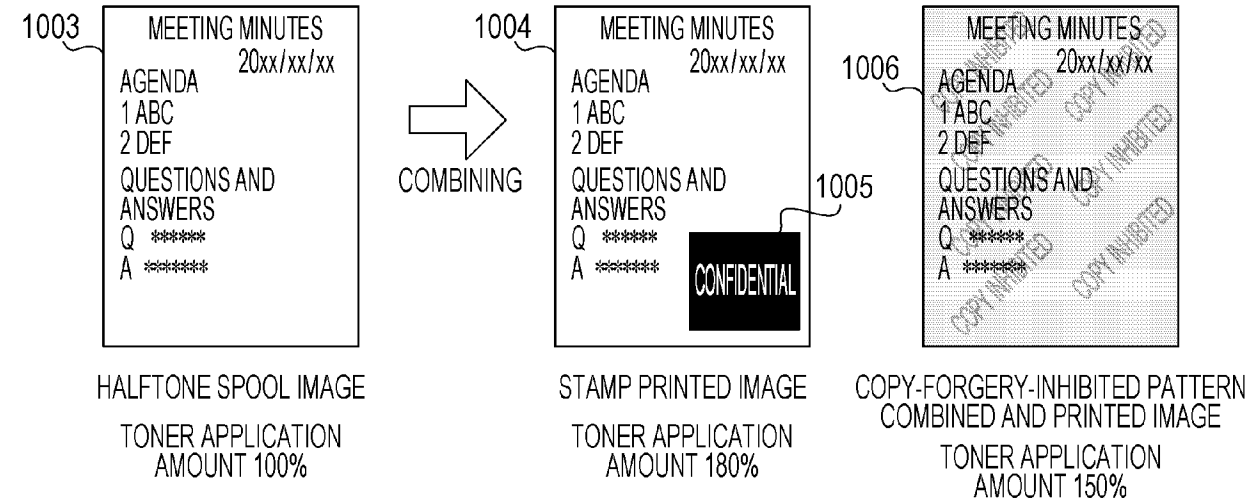

With reference to FIGS. 10A and 10B, a copy-forgery-inhibited pattern or stamp combining process in step S804 will be explained.

An image 1001 of FIG. 10A is a stored image to which a halftone process is performed by the halftone processing unit 312. A dashed line area 1002 of the image 1001 indicates a copy-inhibited area. The copy-inhibited area is defined by the copy-inhibited document determining unit 327. As illustrated in FIG. 10B, the copy-inhibited area is filled by the filling processing unit 329 in step S802 of FIG. 8. The toner application amount of the copy-inhibited area changes from "100%" before filling to "200%" after filling, for example.

Further, FIG. 10B illustrates a stamp-added image 1004 in which a stamp 1005 is added to the halftone image 1003 and a copy-forgery-inhibited pattern combined image 1006 in which a copy-forgery-inhibited pattern is combined to a halftone image. In FIG. 10B, the toner application amount of the halftone image is "100%," the toner application amount of the stamp image is "180%," and the toner application amount of the copy-forgery-inhibited pattern combined image is "150%." As described above, an example that image processing is executed on image data after the halftone process and the toner application amount is increased has been explained.

The fixing temperature control method according to the present embodiment enables to correctly generate information used to control the temperature of the fixing unit (fixing section) and notifies it to the print controller 302 even when an increase of the application amount occurs after detecting the application amount from image data.

Figure 9:
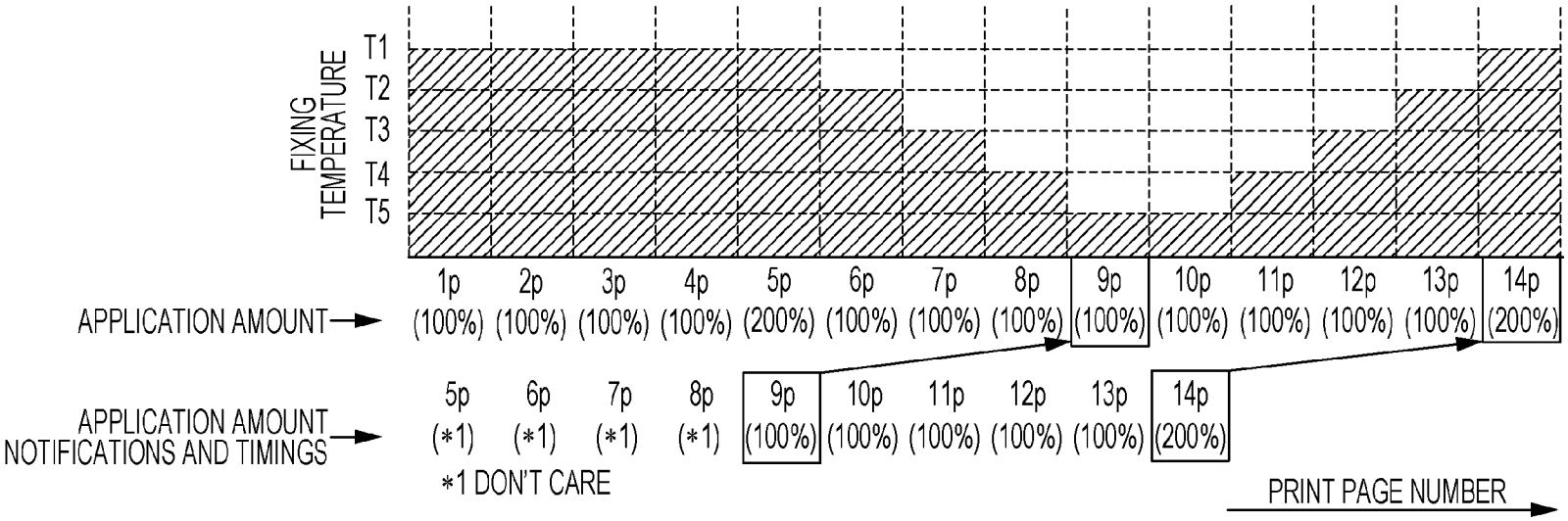
FIG. 9 is a diagram illustrating an example of a fixing temperature control in printing operation according to the present embodiment.

FIG. 9 is a diagram illustrating an example of a temperature control of the fixing unit executed in the process flows of FIGS. 7A and 7B. The horizontal axis represents print page numbers and the vertical axis represents fixing temperatures to fix the pages. Here, toner application amounts of the respective pages are shown in percentage under the page numbers. In FIG. 9, the fixing temperature control information previously notified to print a target page is application amount information. In FIG. 9, timings to notify the application amount information are also shown. In FIG. 9, a case that data of 14 pages is received and the toner application amounts of the fifth page and the 14th page are 200% and the toner application amounts of other pages are 100% will be explained as an example. Here, in the image forming apparatus 101 according to the present embodiment, the relationship between the toner application amounts and the temperatures required for fixing is illustrated in FIG. 5. The temperature required to fix an image with toner application amount of 200% is set as T1 and the temperature required to fix an image with toner application amount of 100% is set as T5.

The first to fourth pages are fixed at the maximum temperature T1 not to lower the productivity. In order to control the fixing temperature from the fifth page, the toner application amount of the fifth page is detected while fixing the first page and the detected toner application amount is notified to the fixing temperature control unit 319. Further minimum temperature required for fixing the detected toner application amount is notified to the fixing temperature control unit 319. Similarly, the toner application amount of the ninth page which is four pages after the fifth page is detected while fixing the fifth page and a minimum temperature required for fixing is notified to the fixing temperature control unit 319. Here, the target temperature T5 is notified. The pages with toner application amounts already notified when the fifth page is fixed are image data of the sixth to ninth pages, which are four pages after the fifth page. Since the toner application amounts of the data from sixth to ninth pages are all 100%, the target temperature is T5. Thus, it is determined that the fixing temperature can be lowered from the current temperature T1.

The toner application amount of the 14th page is detected when fixing the toner of the 10th page and the minimum temperature that enables fixing is notified to the fixing temperature control unit 319. The toner application amount of the 14th page is 200% and the fixing temperature needs to be T1 to fix the toner of the 14th page. In order to control the fixing temperature of the 14th page to be T1, the fixing temperature control unit 319 controls to raise the temperature of the fixing unit from the 11th page.

As described above, in order to notify the toner application amount of the page which is the fourth page after the target page, the image after halftone process and the toner application amount of each page are stored in step S710. In other words, image data of several pages required to notify in advance is temporarily stored in the RAM 306 as a spool memory and the timing of the image transfer is adjusted.

With the above described controlling, the temperature control of the fixing unit according to the toner application amount can be executed without lowering the productivity and the power consumption can be reduced.

Further, the present embodiment has been explained using toner as color materials; however, the color materials may be ink. When ink is used, the toner application amount detection unit 311 of FIG. 3 is replaced with an ink amount detection unit 311.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-124600, filed Jun. 13, 2013, which is hereby incorporated by reference herein in its entirety.

What is claimed is:

1. An image forming apparatus for controlling temperature of a fixing section that fixes a color material on a printing medium, the image forming apparatus comprising:

a determination unit configured to determine whether image data is a copy-inhibited image; and a control unit configured to control the temperature of the fixing section so that the temperature of the fixing section becomes a predetermined temperature in a case where the determination unit determines that the image data is the copy-inhibited image and control the temperature of the fixing section by using a fixing temperature corresponding to a color material amount obtained from the image data in a case where the determination unit determines that the image data is not the copy-inhibited image.

2. The image forming apparatus according to claim 1, further comprising a processing unit configured to process the image data in a case where the determination unit determines that the image data is the copy-inhibited image.

3. The image forming apparatus according to claim 2, wherein processing in the processing unit is a process to convert at least a part of the image data into a part having a density equal to or greater than a predetermined value.

4. An image forming apparatus comprising:

an obtaining unit configured to obtain a control material amount from image data;

a determination unit configured to determine whether the image data is a copy-inhibited image; and a control unit configured to control a temperature of a fixing section targeting a predetermined temperature without controlling a temperature of the fixing section using the color material amount obtained from the image data in a case where the determination unit determines that the image data is the copy-inhibited image.

5. An image forming method for controlling temperature of a fixing section that fixes a color material on a printing medium, the image forming method comprising:

determining whether image data is a copy-inhibited image; and controlling the temperature of the fixing section so that the temperature of the fixing section becomes a predetermined temperature in a case where it is determined that the image data is the copy-inhibited image as a determining result in the determining, and controlling the temperature of the fixing section using a fixing temperature corresponding to a color material amount obtained from the image data in a case where it is determined that the image data is not the copy-inhibited image as a determination result in the determining.

6. A non-transitory computer readable medium storing a program that causes a computer to execute as:

a determination unit configured to determine whether image data is a copy-inhibited image; and a control unit configured to control temperature of a fixing section so that the temperature of the fixing section to be a predetermined temperature in a case where the determination unit determines that the image data is the copy-inhibited image, and control the temperature of the fixing section by using a fixing temperature corresponding to a color material amount obtained from the image data in a case where the determination unit determines that the image data is not the copy-inhibited image.

7. An image forming apparatus for controlling temperature of a fixing section that fixes a color material on a printing medium, the image forming apparatus comprising:

a determination unit configured to determine whether image data is a copy-inhibited image;

a processing unit configured to perform a process for increasing a density of at least a part of the image data, in a case where the determination unit determines that the image data is the copy-inhibited image; and a control unit configured to control the temperature of the fixing section so that the temperature of the fixing section becomes a fixing temperature corresponding to an image obtained by performing the process on the image data by the processing unit in a case where the determination unit determines that the image data is the copy-inhibited image, and control the temperature of the fixing section by using a fixing temperature corresponding to a color material amount of the image data in a case where the determination unit determines that the image data is not the copy-inhibited image.

8. A control method of an image forming apparatus for controlling temperature of a fixing section that fixes a color material on a printing medium, the method comprising:

determining whether image data is a copy-inhibited image;

performing a process for increasing a density of at least a part of the image data, in a case where the determining determines that the image data is the copy-inhibited image; and controlling the temperature of the fixing section so that the temperature of the fixing section becomes a fixing temperature corresponding to an image obtained by the performing the process on the image data in a case where the determining determines that the image data is the copy-inhibited image, and controlling the temperature of the fixing section by using a fixing temperature corresponding to a color material amount of the image data in a case where the determining determines that the image data is not the copy-inhibited image.

9. A non-transitory computer-readable medium having stored thereon instructions to execute a control method of an image forming apparatus for controlling temperature of a fixing section that fixes a color material on a printing medium, the method comprising:

determining whether image data is a copy-inhibited image;

performing a process for increasing a density of at least a part of the image data, in a case where the determining determines that the image data is the copy-inhibited image; and controlling the temperature of the fixing section so that the temperature of the fixing section becomes a fixing temperature corresponding to an image obtained by the performing the process on the image data in a case where the determining determines that the image data is the copy-inhibited image, and controlling the temperature of the fixing section by using a fixing temperature corresponding to a color material amount of the image data in a case where the determining determines that the image data is not the copy-inhibited image.

* * * * *